United States Patent [19]

Jarvis

[11] 4,387,671

[45] Jun. 14, 1983

[54] AIR FILTER FOR A COOLING SYSTEM OVERFLOW CONTAINER

[76] Inventor: Robert D. Jarvis, 5747 S. 148th Ct., Omaha, Nebr. 68137

[21] Appl. No.: 283,068

[22] Filed: Jul. 13, 1981

[51] Int. Cl.[3] ..... F01P 11/02; B01D 46/10

[52] U.S. Cl. ..... 123/41.27; 55/385 B; 55/385 C; 55/491; 55/493; 55/501; 55/505; 220/371

[58] Field of Search ..... 55/385 B, 385 C, 491, 55/493, 501, 505, 510; 123/41.27; 220/367, 371, 123/372

[56] References Cited

U.S. PATENT DOCUMENTS

| | | | |
|---|---|---|---|
| 1,940,601 | 12/1933 | McClrery et al. | 55/501 |
| 2,071,881 | 2/1937 | Krause et al. | 55/501 |
| 2,074,195 | 3/1937 | Uphoff | 123/41.27 |
| 2,784,801 | 3/1957 | Lunde | 220/367 |
| 3,130,025 | 4/1964 | Bowden et al. | 55/510 |
| 3,265,048 | 8/1966 | Herbon | 123/41.27 |
| 4,175,671 | 11/1979 | Holl et al. | 220/367 |

*Primary Examiner*—David L. Lacey

*Attorney, Agent, or Firm*—Zarley, McKee, Thomte, Voorhees & Sease

[57] ABSTRACT

An air filter is described which is used in conjunction with an overflow receptacle or container of an engine cooling system. The container is in fluid communication with the engine cooling system so that coolant may flow from the cooling system to the container when the coolant expands within the cooling system and to permit the coolant to be drawn back inwardly into the cooling system as the coolant cools. The upper end of the container is provided with a fill opening having a threadadly mounted closure element thereon. The closure element is provided with a plurality of openings formed therein to permit air to be drawn into the container as the coolant therein is drawn into the cooling system and to permit air to escape outwardly therethrough when coolant is passing from the cooling system into the container. A filter is positioned over the openings in the closure element together with means for maintaining the same thereon so that the air being drawn into the container will be filtered to remove foreign particles or substances therefrom.

1 Claim, 5 Drawing Figures

AIR FILTER FOR A COOLING SYSTEM OVERFLOW CONTAINER

BACKGROUND OF THE INVENTION

In most modern day engine cooling systems, an overflow tank or container is provided for receiving coolant from the cooling system as the coolant therein expands due to heating. As the coolant in the cooling system cools, the coolant in the overflow container is drawn back into the cooling system. A problem associated with the conventional overflow containers is that air is drawn into the container as the coolant flows back into the cooling system and that the air normally contains many foreign substances such as dirt, etc.. The dirt drawn into the overflow container becomes mixed with the coolant and contaminates the same which causes plugging or clogging of the cooling system as well as the engine water jackets. Contamination of the coolant also causes undue wear of such engine parts as the water pump due to the abrasive characteristics of the dirt in the coolant.

Therefore, it is a principal object of the invention to provide an air filter for an engine cooling system overflow container.

A further object of the invention is to provide a means for filtering foreign particles from the air being drawn into the overflow container of an engine cooling system.

A further object of the invention is to provide a means for filtering air being drawn into an overflow container which is inexpensive and which is easily serviced.

A still further object of the invention is to provide an air filter of the type described which includes means for preventing contamination thereof by overflowing coolant.

These and other objects will be apparent to those skilled in the art.

SUMMARY OF THE INVENTION

A closure element is mounted on the fill opening of an expansion tank or container of an engine cooling system. The closure elements include a plurality of openings formed therein to permit air to pass therethrough. An air filter is positioned over the openings in the closure element to prevent foreign particles or substances from being drawn inwardly into the container. The filter is cylindrical in shape and is maintained on the closure element by a multi-sided flat plate positioned thereover and held thereon by a bolt or the like.

DESCRIPTION OF THE PREFERRED EMBODIMENT

Figure 1:
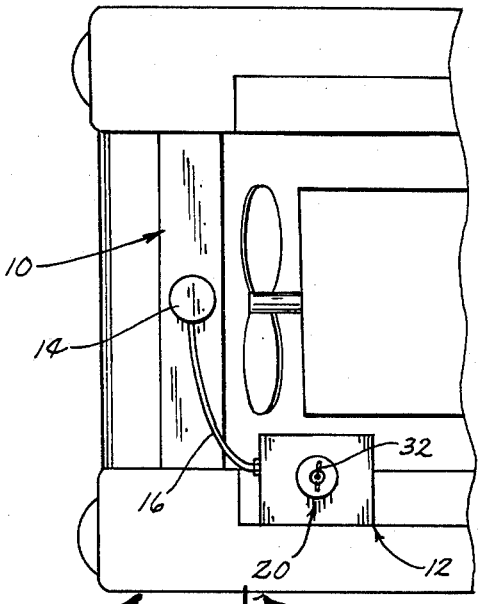
FIG. 1 is a schematic view of an engine cooling system and the overflow container associated therewith.
Figure 2:
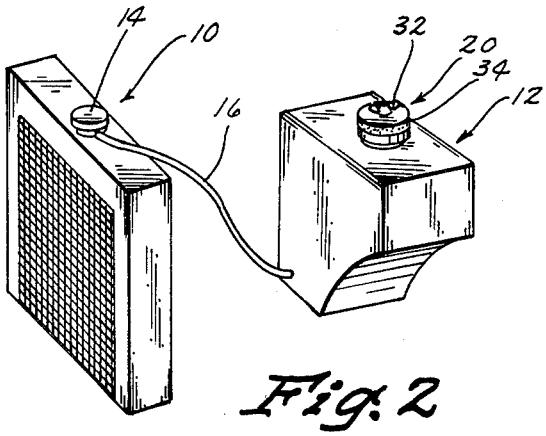
FIG. 2 is a perspective view of the radiator and overflow container.
Figure 4:
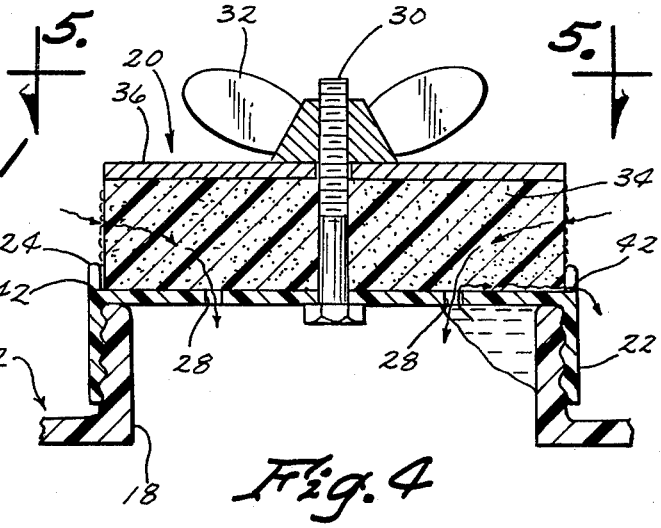
FIG. 4 is a sectional view seen on lines 4—4 of FIG. 3.
Figure 3:
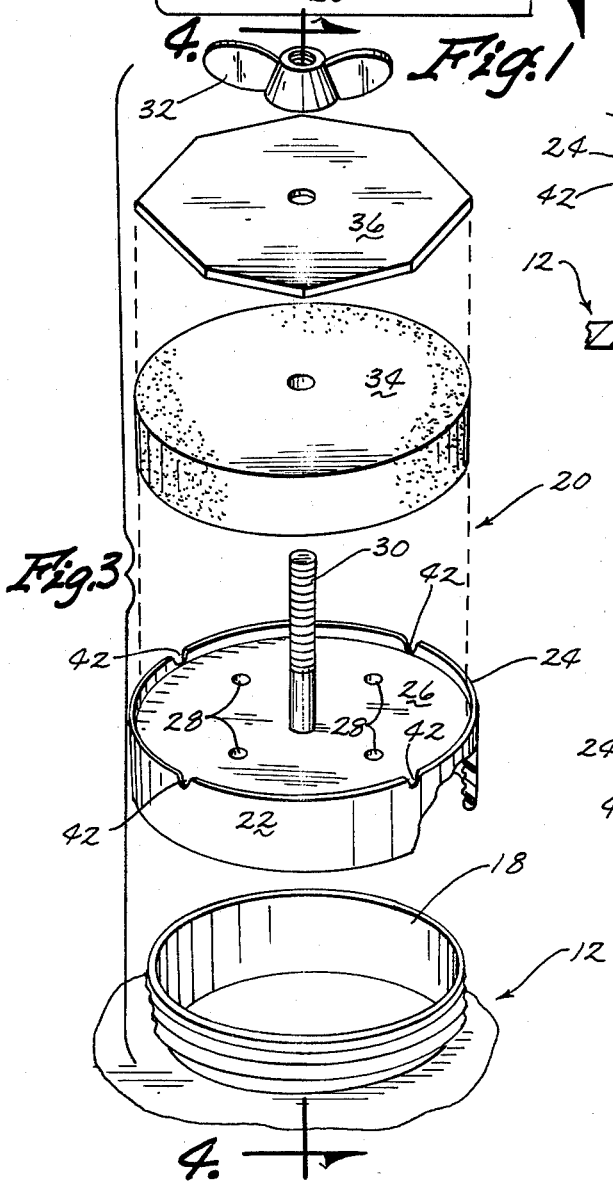
FIG. 3 is an exploded perspective view of the closure device and filter.

In FIG. 1, an engine cooling system is generally depicted including a radiator 10 having a conventional overflow tank, receptacle or container 12 fluidly connected to the overflow valve-cap 14 mounted on the radiator by tube 16. Ordinarily, the tube 16 is in communication with the lower end of the container 12 as illustrated but it should be understood that other types of connections are employed.

As the coolant in the radiator 10 expands due to heating, the coolant in the radiator overflows through the valve-cap 14 and into the container 12. As the coolant in the radiator contracts due to cooling, the coolant in the container 12 is drawn back into the radiator 16 in conventional fashion.

Substantially all of the overflow containers 12 include a fill opening 18 formed at the upper end thereof to facilitate the addition of coolant to the cooling system without removing the valve-cap 14. It is to the fill opening 18 that the apparatus 20 of this invention is affixed. Apparatus 20 generally comprises a cylindrical skirt portion 22 having internal threads adapted to be threadably mounted on the external threads of the fill opening 18. An annular ridge 24 extends above the top portion 26 as best illustrated in the drawings. Top portion 26 is provided with a plurality of spaced-apart openings 28 formed therein. Bolt or stud 30 is secured to top portion 26 and extends upwardly therefrom and is adapted to receive a wing nut 32 thereon.

Figure 5:
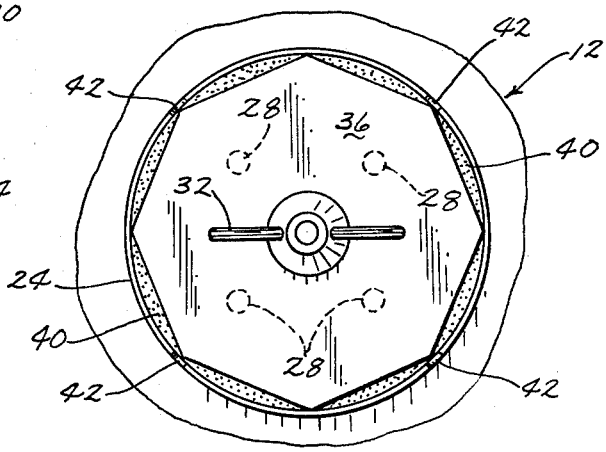
FIG. 5 is a top view of the closure device.

The numeral 34 refers to a cylindrical air filter material which is positioned over top portion 26 as illustrated in the drawings. As seen in the drawings, the vertical thickness of filter 34 is greater than the height of the annular ridge 24 to permit air to be drawn inwardly through the filter at the periphery thereof. Preferably, a multi-sided flat plate 36 is positioned over the upper end of the filter 34 to aid in maintaining the filter 34 on the closure element. The purpose in having the cover 36 multi-sided is best illustrated in the top view of FIG. 5. Air may be drawn inwardly through the sides of the filter and may also be drawn inwardly therethrough at the exposed upper portions of the filter generally indicated by the reference numeral 40. Preferably, cover 36 is comprised of a transparent material to permit visual inspection of the filter 34. Annular ridge 24 is also provided with a plurality of spaced-apart slits 42 formed therein to permit coolant to pass outwardly therethrough should the coolant overflow from the container 12.

In operation, the closure element or apparatus 20 is mounted on the fill opening 18. As the coolant in the cooling system expands or overflows into the container 12, the air in the container 12 will pass outwardly through the openings 28 and through the filter. As the coolant in the cooling system contracts by cooling, the coolant in the container 12 will be drawn back into the cooling system. As the coolant flows from the container 12 to the radiator 10, air is drawn through the filter 34, through openings 28 and into the interior of the container 12. The fact that the air being drawn into the container must pass through the filter material 34 insures that the foreign particles or substances carried by the air will be removed therefrom so that the coolant in the container will not be contaminated.

The elimination of foreign particles or substances from the coolant prevents plugging or clogging of the cooling system and substantially reduces wear on moving parts of the cooling system such as the water pump, etc.

Thus it can be seen that the apparatus of this invention accomplishes at least all of its stated objectives.

I claim:

1. In combination with a vehicle engine cooling system containing a coolant, an overflow container fluidly connected to the cooling system, said container having a fill opening formed therein adjacent the upper end thereof which is in communication with the atmosphere to permit air in the container to pass outwardly therethrough when coolant from the cooling system is overflowing thereinto and to permit air to pass inwardly therethrough when the coolant in the container is being drawin into the cooling system, and an air filter means extending across said opening whereby the air entering said container will pass through said filter means and will be filterd to remove foreign substances carried thereby, a closure means removably mounted on said fill opening to close the same, said filter means being operatively mounted on said closure means, said closure means having air openings formed therein to permit the air to pass therethrough, said closure means comprising an annular skirt portion which is threadably mounted on said container, a top portion extending over said skirt portion, said top portion having a plurality of the said air openings formed therein to permit air to pass therethrough, said filter means being positioned over said top portion, and means maintaining said filter means on said top portion, said closure means having an upstanding annular ridge extending therearound which partially embraces said filter means, said annular ridge having a plurality of slits formed therein to permit coolant to pass outwardly therethrough in the event that coolant should overflow from said container.

* * * * *